US009187721B2

(12) United States Patent
Nishina et al.

(10) Patent No.: US 9,187,721 B2
(45) Date of Patent: Nov. 17, 2015

(54) FRAMED SOAP AND METHOD FOR PRODUCING THE SAME

(75) Inventors: Tetsuo Nishina, Takatsuki (JP); Takahito Makita, Ibaraki (JP); Takahiro Okuda, Machida (JP); Tomoko Toda, Sakai (JP); Uhei Tamura, Ibaraki (JP); Shogo Nagura, Ibaraki (JP); Yoshinobu Saito, Ibaraki (JP)

(73) Assignee: P & PF Co., Ltd., Osaka (JP)

( * ) Notice: Subject to any disclaimer, the term of this patent is extended or adjusted under 35 U.S.C. 154(b) by 34 days.

(21) Appl. No.: 13/638,044

(22) PCT Filed: Feb. 25, 2011

(86) PCT No.: PCT/JP2011/054299

§ 371 (c)(1),
(2), (4) Date: Sep. 28, 2012

(87) PCT Pub. No.: WO2011/122187

PCT Pub. Date: Oct. 6, 2011

(65) Prior Publication Data

US 2013/0017988 A1 Jan. 17, 2013

(30) Foreign Application Priority Data

Mar. 29, 2010 (JP) ..... 2010-074009
Aug. 12, 2010 (JP) ..... 2010-180801

(51) Int. Cl.
*C11D 17/02* (2006.01)
*C11D 13/16* (2006.01)

(52) U.S. Cl.
CPC ..... *C11D 17/02* (2013.01); *C11D 13/16* (2013.01)

(58) Field of Classification Search
None
See application file for complete search history.

(56) References Cited

U.S. PATENT DOCUMENTS

| | | | | |
|---|---|---|---|---|
| 5,972,860 | A | 10/1999 | Eshita et al. | |
| 2002/0132743 | A1 | 9/2002 | Saito et al. | |
| 2004/0157756 | A1 * | 8/2004 | Kuroda | 510/141 |

FOREIGN PATENT DOCUMENTS

| | | |
|---|---|---|
| CN | 1159427 | 7/2004 |
| EP | 1445306 | 8/2004 |
| JP | 59-27796 | 7/1984 |
| JP | 10-168494 | 6/1998 |
| JP | 11-43699 | 2/1999 |
| JP | 2005-2255 | 1/2005 |
| JP | 2006-45437 | 2/2006 |
| JP | 2006-176646 | 7/2006 |

OTHER PUBLICATIONS

International Preliminary Report on Patentability for corresponding PCT/JP2011/054299 mailed Nov. 1, 2012, nine pages.
Patent Abstract and machine translation for JP 2005-002255 published Jan. 6, 2005, 11 pages.

(Continued)

*Primary Examiner* — Necholus Ogden, Jr.
(74) *Attorney, Agent, or Firm* — Rankin, Hill & Clark LLP

(57) ABSTRACT

The present invention provides a framed soap containing uniformly entrained bubbles and a method for producing the same. The framed soap of the present invention is produced by cooling and solidifying in a cylindrical cooling frame and characterized in that 10 volume % or higher air bubbles having a number average particle diameter of 65 μm or smaller are uniformly entrained.

15 Claims, 5 Drawing Sheets

(56) References Cited

OTHER PUBLICATIONS

Patent Abstract and machine translation for JP 2006-045437 published Feb. 16, 2006, 13 pages.
Patent Abstract and machine translation for JP 2006-176646 published Jul. 6, 2006, 12 pages.
Patent Abstract and machine translation for JP-11-043699 published Feb. 16, 1999, nine pages.
International Search Report for corresponding PCT/JP2011/054299 mailed May 31, 2011, six pages.
Extended European Search Report dated Nov. 6, 2014 issued in the corresponding European patent application No. 11762427.0.

* cited by examiner

FRAMED SOAP AND METHOD FOR PRODUCING THE SAME

RELATED APPLICATIONS

This application claims the priority of Japanese Patent Application No. 2010-074009 filed on Mar. 29, 2010 and Japanese Patent Application No. 2010-180801 filed on Aug. 12, 2010, which are incorporated herein by reference.

FIELD OF THE INVENTION

The present invention relates to a framed soap and a method for producing the same, and in particular, relates to a framed soap, wherein air bubbles are introduced into the framed soap by placing high-temperature molten soap in the frame, cooling, and solidifying, and a method for producing the same.

BACKGROUND OF THE INVENTION

In the past, the air bubble-containing soap, whose specific gravity is decreased by introducing air bubbles etc. so that it can float on water, has been publicly known.

On the other hand, the soap preparation methods are broadly classified into the framing method and the milling method.

The framed soap is prepared by pumping molten soap at a high temperature into a cylindrical cooling frame, cooling/solidifying the soap together with the cylindrical cooling frame, and then cutting and forming.

On the other hand, in the case of milled soap, soap chips that are formed beforehand are kneaded and plodded to shape a bar soap.

Among these common soap production methods, it has been very difficult to produce an air bubble-containing soap especially by the framing method.

That is, in the framing method, high-temperature/low-viscosity molten soap is pumped into a cylindrical cooling frame. Therefore, even when air bubbles are entrained in the molten soap, air bubbles float and separate inside the cylindrical frame during the cooling process. By cutting and shaping after cooling, a soap containing a large amount of air bubbles and a soap containing a very small amount of air bubbles are generated. Thus, it is difficult to obtain an air bubble-containing soap of uniform quality.

Therefore, in order to produce an air bubble-containing soap, the milling method was used in the past (patent literature 1). Alternatively, air bubbles were entrained in molten soap by individual shaping (method in which molten soap is poured into a frame of one soap, patent literature 2 etc.). Thus, either of these production methods has been used.

Patent literature 1: Japanese publication of examined application No. S59-27796

Patent literature 2: Japanese unexamined patent publication No. 2006-176646

DISCLOSURE OF THE INVENTION

Problem to be Solved by the Invention

The present invention was made in view of the above-described conventional art. An object of the invention is to provide a framed soap containing uniformly entrained bubbles and a method for producing the same.

Means to Solve the Problem

The present inventors have diligently studied to solve the above-described problems. As a result, the present inventors have found that a framed soap containing a large amount of uniformly entrained bubbles can be obtained through the production by cooling/solidifying in a cylindrical cooling frame and by uniformly entraining 10 volume % or higher air bubbles having a number average particle diameter of 65 μm or smaller, thus leading to the completion of the present invention.

That is, the framed soap of the present invention is produced with the use of a cylindrical cooling frame and characterized in that 10 volume % or higher and especially preferably 20 volume % or higher air bubbles having a number average particle diameter of 65 μm or smaller and especially preferably 50 μm or smaller are uniformly entrained.

In addition, it is preferable that the fatty acid soap part is 20 to 40 mass % of the composition in the above-described framed soap, and isostearic acid is 2 to 8 mass % and stearic acid is 4 to 14 mass % in the fatty acid composition.

In addition, it is preferable that the saccharide/moisturizing agent part is 30 to 50 mass % of the composition in the above-described framed soap, and polyethylene glycol 1500 is 5 to 20 mass % in the saccharide/moisturizing agent part.

In addition, in the above-described framed soap, it is preferable that the cylindrical cooling frame is a long cylindrical resin container wherein plural resin individual sections are connected through liquid channels.

In addition, in the above-described framed soap, it is preferable that the framed soap is a small soap of 50 g or less.

In addition, the production method of the framed soap of the present invention is characterized in that when high-temperature molten soap with entrained air bubbles is pumped into a cylindrical cooling frame, the molten soap is pumped into the cooling frame while fine and homogeneous air bubbles are being formed with a mill arranged in the vicinity of the pumping pipe spout.

In addition, in the above-described method, it is preferable that the mill is equipped with a cylindrical stator of about the same diameter as the pipe and a rotor that has a gap of 0.4 mm or less to the stator, rotates around the same axis as the flow channel, and has blades on its outer periphery.

In addition, in the above-described method, it is preferable that the diameter of the cylindrical stator is 100 to 200 mm and the rotor speed is 2000 to 4000 rpm.

In addition, in the above-described method, it is preferable that the molten soap is 60 to 65° C. when the soap is pumped into the cooling frame.

Effect of the Invention

According to the framed soap of the present invention, because 10 volume % or higher air bubbles having a number average particle diameter of 65 μm or smaller are uniformly entrained, the specific gravity is low and it can be low-cost.

In addition, by blending 30 to 50 mass % of a moisturizing agent and/or saccharide, cracks, fractures, etc. of the material bar are reduced regardless of the entrainment of a large amount air bubbles, and the production efficiency can be increased.

According to the production method of the framed soap of the present invention, by the adoption of a pipeline mill, the soap with an air bubble diameter of 65 μm or less and especially preferably 50 μm or less can be obtained, and no problem is generated in the distribution of air bubbles inside the cooling frame.

BEST MODE FOR CARRYING OUT THE INVENTION

Figure 1:
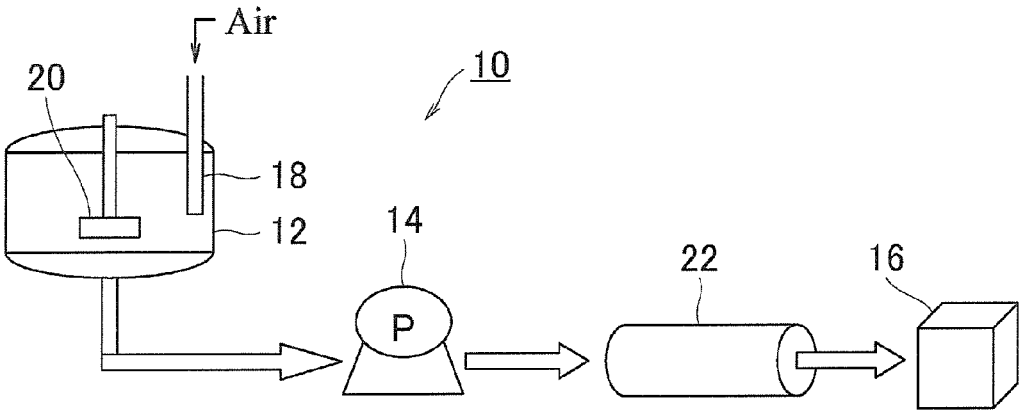
FIG. 1 is an illustration of the production process of the framed soap of the present invention.

The framed soap of the present invention is produced by cooling/solidifying in a cylindrical cooling frame and characterized in that 10 volume % or higher air bubbles having a number average particle diameter of 65 μm or smaller are uniformly entrained. This soap is characterized in that the solubility and foaming property are good and the soap does not swell easily.

In the following, the composition of the present invention is described in detail.

The framed soap of the present invention is produced by pumping molten soap into a cylindrical cooling frame, cooling, and solidifying. It is especially preferable to apply it to a small soap of 50 g or less.

It is preferable that the framed soap of the present invention comprises 20 to 40 mass part of fatty acid soap part, 30 to 50 mass part of saccharide/moisturizing agent part, and 5 to 20 mass part of non-fatty acid soap surfactant part in the composition.

[Fatty Acid Soap]

The fatty acids of fatty acid sodium salts or fatty acid sodium/potassium/organic amine mixed salts, which are used in the framed soap of the present invention, are saturated or unsaturated fatty acids having preferably 8 to 20 and more preferably 12 to 18 carbon atoms, and they may be either linear or branched. The specific examples include lauric acid, myristic acid, palmitic acid, stearic acid, oleic acid, isostearic acid, ricinoleic acid, linoleic acid, linolenic acid, 12-hydroxy stearic acid, and their mixture such as tallowate, coconut oil fatty acid, palm oil fatty acid, and palm kernel oil fatty acid.

The specific examples of the sodium fatty acids include sodium laurate, sodium myristate, sodium palmitate, sodium stearate, sodium oleate, sodium isostearate, sodium ricinoleate, sodium linoleate, sodium linolenate, sodium 12-hydroxy stearate, sodium tallowate, sodium coconut oil fatty acid, sodium palm oil fatty acid, and sodium palm kernel oil fatty acid. These may be used either alone or in combination of two or more. Among the above sodium fatty acids, sodium laurate, sodium myristate, sodium palmitate, sodium stearate, sodium oleate, and sodium isostearate are preferably used.

The specific examples of the fatty acid sodium/potassium mixed salts include sodium/potassium laurate, sodium/potassium myristate, sodium/potassium palmitate, sodium/potassium stearate, sodium/potassium oleate, sodium/potassium isostearate, sodium/potassium ricinoleate, sodium/potassium linoleate, sodium/potassium linolenate, sodium/potassium 12-hydroxy stearate, sodium/potassium tallowate, sodium/potassium coconut oil fatty acid, sodium/potassium palm oil fatty acid, and sodium/potassium palm kernel oil fatty acid. These may be used either alone or in combination of two or more. Among the above fatty acid sodium/potassium mixed salts, sodium/potassium laurate, sodium/potassium myristate, sodium/potassium palmitate, sodium/potassium stearate, sodium/potassium oleate, and sodium/potassium isostearate are preferably used.

In the present invention, the isostearic acid soap is preferably 2 to 8 mass % and the stearic acid soap is preferably 4 to 14 mass % in the fatty acid composition. The stearic acid soap is especially preferably 4 to 12 mass % in the fatty acid composition. In these ranges, fractures and cracks can be prevented when the soap material bar is removed from the cooling frame; in addition, the stickiness can be effectively suppressed.

The content of fatty acid sodium salts or fatty acid sodium/potassium mixed salts in the framed soap of the present invention is preferably 20 to 40 mass % and especially preferably 20 to 30 mass % in the case of a small soap with a product weight of 50 g or less. If this content is less than 20 mass %, the freezing point becomes low and the surface will melt in the long-term storage; thus the commercial value may be reduced. On the other hand, if the content exceeds 40 mass %, the solubility by rubbing decreases and the usability as a small soap tends to be reduced.

In addition, in the fatty acid sodium/potassium mixed salts, the mole ratio of the salt-constituting sodium and potassium (sodium/potassium ratio) is preferably 5/1 to 2/1, and especially preferably 8/2 to 2/1. If the sodium/potassium ratio goes beyond 2/1 and the percentage of potassium increases, the freezing point is lowered and the surface will melt in the long-term storage; thus the commercial value may be reduced.

In addition, the counter ion of the fatty acid can be an organic amine.

Here, as preferable specific examples of the organic amines, diethanolamine, triethanolamine, triethylamine, trimethylamine, diethylamine, etc. can be listed. Among them, triethanolamine is especially preferable. The organic amine can be used either alone or in combination of two or more.

[Saccharide/Moisturizing Agent]

It is preferable that the framed soap of the present invention comprises saccharide or moisturizing agent.

As preferable saccharide or moisturizing agent used in the present invention, multitol, sorbitol, glycerin, 1,3-butylene glycol, propylene glycol, polyethylene glycol, sugar, pyrrolidone carboxylate, sodium pyrrolidone carboxylate, hyaluronic acid, polyoxyethlene alkyl glucoside ether, etc. can be listed. It is preferable to blend 30 to 50 mass % of saccharide and moisturizing agent in the composition.

Among them, it is preferable to blend 5 to 20 mass % of PEG1500 in the saccharide/moisturizing agent part. By blending PEG1500, the high solubility by rubbing, which is specifically demanded for a small soap, is improved.

In addition, it is preferable to blend 0.001 to 0.01 mass % of PEG-90M (highly-polymerized polyethylene glycol) in the composition to improve the brittleness, which is observed in the air bubble-containing soap.

[Amphoteric Surfactant]

It is preferable that the framed soap of the present invention comprises the below-described amphoteric surfactant as a non-fatty acid soap surfactant.

As the amphoteric surfactant used in the framed soap of the present invention, the amphoteric surfactants represented by the below-described chemical formulas (A) to (C) can be listed.

[Formula 1]

(A)

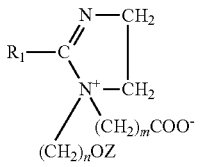

[In the formula, $R_1$ represents an alkyl group or alkenyl group having 7 to 21 carbon atoms, n and m are either identical to or different from each other and represent integers from 1 to 3, Z represents a hydrogen atom or $(CH_2)_pCOOY$ (here, p is an integer from 1 to 3, and Y is an alkali metal, alkaline earth metal, or an organic amine.)],

[Formula 2]

(B)

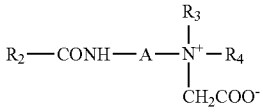

[In the formula, $R_2$ represents an alkyl group or alkenyl group having 7 to 21 carbon atoms, $R_3$ and $R_4$ are either identical to or different from each other, representing lower alkyl groups, and A represents a lower alkylene group.], and

[Formula 3]

(C)

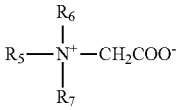

[In the formula, $R_5$ represents an alkyl group or alkenyl group having 8 to 22 carbon atoms, $R_6$ and $R_7$ are either identical to or different from each other, and they represent lower alkyl groups.].

In chemical formula (A), the "alkyl group having 7 to 21 carbon atoms", or $R_1$ is either linear or branched, and the number of carbon atoms is preferably 7 to 17. Furthermore, the "alkenyl group having 7 to 21 carbon atoms", or $R_1$ can be either linear or branched, and the number of carbon atoms is preferably 7 to 17. The examples of "alkali metals" of Y include sodium and potassium. The examples of "alkaline earth metals" of Y include calcium and magnesium. The examples of "organic amines" of Y include monoethanolamine, diethanolamine, and triethanolamine.

Specific examples of amphoteric surfactants represented by chemical formula (A) include imidazolinium betaine-types such as 2-undecyl-N-carboxymethyl-N-hydroxyethyl imidazolium betaine (compound synthesized from lauric acid, hereinafter, for convenience, it may be also called "lauroyl imidazolinium betaine"), 2-heptadecyl-N-carboxymethyl-N-hydroxyethyl imidazolium betaine (compound synthesized from stearic acid), 2-alkyl or alkenyl-N-carboxymethyl-N-hydroxyethyl imidazolium betaine synthesized from palm oil fatty acid ($R_1$ is a mixture of $C_7$ to $C_{17}$, hereinafter, for convenience, it may be also called "cocoyl imidazolinium betaine").

In chemical formula (B), the "alkyl group having 7 to 21 carbon atoms" and the "alkenyl group having 7 to 21 carbon atoms", or $R_2$ is the same as $R_1$ of chemical formula (A). Furthermore, the "lower alkyl groups", or $R_3$ and $R_4$ are linear or branched alkyl groups having 1 to 5 carbon atoms, and preferably alkyl groups having 1 to 3 carbon atoms. Furthermore, the "lower alkylene group", or A is a linear or branched alkylene group having 1 to 5 carbon atoms, and preferably an alkylene group having 3 to 5 carbon atoms.

The specific examples of the amphoteric surfactants (amide alkyl betaine-type) represented by the formula (B) include amide propyl betaine-type such as coconut oil fatty acid amide propyl dimethyl amino acetic acid betaine ($R_2$ is a mixture of $C_7$ to $C_{17}$).

In chemical formula (C), the "alkyl group having 8 to 22 carbon atoms", or $R_5$ can be either linear or branched, and the number of carbon atoms is preferably 8 to 18. Furthermore, the "alkenyl group having 8 to 22 carbon atoms", or $R_5$ can be either linear or branched, and the number of carbon atoms is preferably 8 to 18. Furthermore, the "lower alkyl groups", or $R_6$ and $R_7$ are the same as $R_3$ and $R_4$ of chemical formula (B).

The specific examples of the amphoteric surfactants (alkyl betaine-type) represented by the formula (C) include lauryl dimethyl amino acetic acid betaine and alkyl or alkenyl dimethyl amino acetic acid betaine ($R_5$ is a mixture of $C_8$ to $C_{18}$).

In the present invention, it is preferable that at least one is selected for use from the group consisting of amphoteric surfactants represented by the above-described chemical formulas (A) to (C). When a plurality of them are used, plural amphoteric surfactants represented by the above-described chemical formula (A) may be used, plural amphoteric surfactants represented by the above-described chemical formula (B) may be used, or plural amphoteric surfactants represented by the above-described chemical formula (C) may be used.

Among the above-described amphoteric surfactants, an imidazolinium betaine-type amphoteric surfactant represented by the above-described chemical formula (A), and in particular, cocoyl imidazolinium betaine is especially preferably used.

When the above-described amphoteric surfactant is blended in the framed soap of the present invention, the fatty acid soap (fatty acid sodium salts or fatty acid sodium/potassium mixed salts) forms a combined salt with the amphoteric surfactant, and the action such as hardness improvement is achieved.

The content of the amphoteric surfactant in the framed soap of the present invention is preferably 2 to 10 mass % and especially preferably 4 to 8 mass %. If this content is less than 2 mass %, the freezing point is lowered and the surface will melt in the long-term storage; thus the commercial value may be reduced. Furthermore, the hardness may be reduced. On the other hand, if the content exceeds 10 mass %, a sticky feeling is generated after use. In addition, the surface changes brown in the long-term storage, and the commercial value may be reduced.

[Nonionic Surfactant]

In the framed soap of the present invention, a nonionic surfactant may be blended as the non-fatty acid soap surfactant. The examples of usable nonionic surfactants include polyoxyethylene (hereinafter, it may be called "POE") hydrogenated oil, polyoxyethylene 2-octyl dodecyl ether, polyoxyethylene lauryl ether, propyleneoxide ethyleneoxide copolymerized block polymer, polyoxyethylene polyoxypropylene cetyl ether, polyoxyethylene polyoxypropylene glycol, polyethylene glycol diisostearate, alkyl glucoside, polyoxyethylene modified silicone (for example, polyoxyethylene alkyl modified dimethyl silicone), polyoxyethylene glyceryl monostearate, and polyoxyethylene alkyl glucoside. These may be used either alone or in combination of two or more. Among the above-described nonionic surfactants, polyoxyethylene hydrogenated oil and propyleneoxide ethyleneoxide copolymerized block polymer are preferably used.

In the framed soap of the present invention, the lowering of the irritation, due to fatty acid soap, can be realized by blending a nonionic surfactant.

The content of the nonionic surfactant in the framed soap of the present invention is preferably 2 to 15 mass % and especially preferably 5 to 12 mass %. If this content is less than 2 mass %, a taut feeling may be generated after use. On the other hand, if the content exceeds 15 mass %, the freezing point is lowered and the surface will melt in the long-term storage; thus the commercial value may be reduced. In addition, a sticky feeling may be generated after use.

[Hydroxyalkyl Ether Carboxylic Acid Salt-Type Surfactant]

In the framed soap of the present invention, the addition of a hydroxyalkyl ether carboxylic acid salt-type surfactant is preferable, and the improvement in the foaming property is observed.

In the present invention, as the preferable hydroxyalkyl ether carboxylic acid salt-type surfactant, the surfactant represented by the below-described chemical formula (D) can be listed.

[Formula 4]

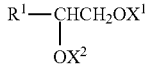

(D)

(In the formula, $R^1$ represents a saturated or unsaturated hydrocarbon group having 4 to 34 carbon atoms; any one of $X^1$ and $X^2$ represents —$CH_2COOM^1$, and the other represents a hydrogen atom; and $M^1$ represents a hydrogen atom, an alkali metal, an alkaline earth metal, an ammonium ion, a lower alkanolamine cation, a lower alkylamine cation, or a basic amino acid cation.)

In the formula, $R^1$ may be either an aromatic hydrocarbon or a linear or branched aliphatic hydrocarbon; however, an aliphatic hydrocarbon, especially an alkyl group or an alkenyl group is preferable. The preferable examples of $R^1$s include butyl group, octyl group, decyl group, dodecyl group, tetradecyl group, hexadecyl group, octadecyl group, docosyl group, 2-ethylhexyl group, 2-hexyldecyl group, 2-octylundecyl group, 2-decyltetradecyl group, 2-undecylhexadecyl group, decenyl group, dodecenyl group, tetradecenyl group, and hexadecenyl group. Among them, decyl group and dodecyl group are excellent in surfactant potency.

In addition, in the formula, any one of $X^1$ and $X^2$ represents —$CH_2COOM^1$, and the examples of $M^1$s include a hydrogen atom, a lithium, a potassium, a sodium, a calcium, a magnesium, an ammonium ion, a monoethanolamine, a diethanolamine, and a triethanolamine.

Specifically, among the above-described (D) hydroxyalkyl ether carboxylic acid salt-type surfactants, dodecane-1,2-diol acetic acid ether sodium salt, wherein H of either of the OH groups of dodecane-1,2-diol is substituted with —$CH_2COONa$, is most preferable.

The content of the hydroxyalkyl ether carboxylic acid salt-type surfactant in the framed soap of the present invention is preferably 0.5 to 15 mass % and especially preferably 0.7 to 10 mass % in terms of the improvement in the foaming property.

[Chelator]

It is preferable that a chelator is added to the framed soap of the present invention.

In addition, the examples of preferable chelators used in the present invention include hydroxyethanedisulfonic acid and its salt. It is more preferable that the chelator is hydroxyethanedisulfonic acid. The blending quantity is preferably 0.001 to 1.0 mass % and more preferably 0.1 to 0.5 mass %. If the blending quantity of hydroxyethanedisulfonic acid and its salt is less than 0.001 mass %, the chelating effect is not satisfactory, and inconvenience such as yellowing over time may be caused. If the blending quantity is more than 1.0 mass %, the irritation to the skin becomes strong and it is not desirable.

In the framed soap of the present invention, the following components can be blended so far as the above-described effect is not undermined. The examples of such optional components include fungicides such as trichlorocarbanilide and hinokitiol; oils; perfumes; pigments; chelators such as edetate trisodium dihydrate; UV absorbers; antioxidants; natural extracts such as dipotassium glycyrrhizinate, psyllium extract, lecithin, saponin, aloe, phellodendron bark, and chamomile; nonionic, cationic or anionic water-soluble polymer; usability improving agents such as lactic acid ester; and foaming property improving agents such as sodium alkyl ether carboxylate, disodium alkyl sulfosuccinate, sodium alkyl isethionate, sodium polyoxyethylene alkyl sulfate, acyl methyl taurine, sodium acyl glutamate, and sodium acyl sarcosinate.

The production method of the framed soap of the present invention is characterized in that when high-temperature molten soap with entrained air bubbles are pumped into a cylindrical cooling frame, the molten soap is pumped into the cooling frame while fine and homogeneous air bubbles are being formed with a mill that is arranged in the vicinity of the pumping pipe spout.

In addition, the fine air bubbles of the molten soap are made to be preferably 40 μm or smaller and especially preferably 36 μm or smaller with the mill.

In addition, it is preferable that the molten soap is adjusted to 60 to 65° C. when the soap is pumped into the cooling frame.

In addition, it is preferable that the mill is equipped with a cylindrical stator of about the same diameter as the pipe and a rotor that has a gap of 0.4 mm or less to the stator, rotates around the same axis as the flow channel, and has blades on its outer periphery.

The diameter of the cylindrical stator is preferably 100 to 200 mm. The rotor speed is preferably 2000 to 4000 rpm and especially preferably 3000 to 4000 rpm.

As the mill used in the production method of the framed soap of the present invention, a commercial pipeline mill (manufactured by PRIMIX Corporation), a micro/nanobubble generator with the use of gas-liquid mixing shear method (manufactured by Kyowa Kisetsu Seisakusho K.K.), a thin-film spin system high-speed mixer (manufactured by PRIMIX Corporation), etc. can be used. Among them, it is especially preferable to use a pipeline mill.

EXAMPLES

The present invention will be further described in the following examples. However, the invention is not limited by these examples.

Prior to illustrating the examples, the methods for the evaluation tests used in the present invention will be explained.

Evaluation (1): Fracture Resistance

The fracture resistance test was carried out for the sample bar soap (material bar). That is, after solidification, the state of the material bar at the time of removal from the cylindrical cooling frame was evaluated by the following evaluation criteria.

A: The fracture resistance of the material bar was good.

B: Cracks were generated on the material bar.

C: The material bar was fractured.

Evaluation (2): Stickiness 10 professional panelists evaluated the stickiness when each sample was used.

A: 8 or more panelists answered that the stickiness was not present.

B: 5 or more and less than 8 panelists answered that the stickiness was not present.

C: Less than 5 panelists answered that the stickiness was not present.

Evaluation (3): Viscosity Increase During Reaction

The viscosity increase of the molten soap during sample stirring was evaluated by the following evaluation criteria.

A: There was free of untoward effects on production due to the viscosity increase during reaction.

C: The viscosity increased too much during reaction and the stirring was difficult.

Evaluation (4): Appearance

The appearance of the shaped sample was evaluated based on the below-described evaluation criteria.

A: The appearance was smooth and good.

C: The appearance was rough and not good.

At first, the present inventors tried the production of air bubble-containing soap by using the basic formulation comprising the below-described fatty acid soap part, saccharide/moisturizing agent part, non-fatty acid soap surfactant part, etc. The method to entrain air bubbles is described in the below-described production method. After the entrainment of air bubbles, the molten soap was placed in various apparatuses shown in Table 1 and then cooled/solidified. The values in the parentheses in the sections of the apparatus pipeline mill in Table 1 are the gaps between the grinding section and the opposing section.

Basic Formulation

| | |
|---|---|
| Fatty acid soap part | 33.0% |
| Lauric acid | 28 parts |
| Myristic acid | 56 parts |
| Stearic acid | 11 parts |
| Isostearic acid | 5 parts |

Neutralized with sodium hydroxide:potassium hydroxide=3:1 (mole ratio)

| | |
|---|---|
| Saccharide/moisturizing agent part | 40.0% |
| Concrete glycerin | 25 parts |
| 1,3-butylene glycol | 15 parts |
| POE(7 mol) glyceryl | 10 parts |
| Polyethylene glycol 1500 | 13 parts |
| Sorbitol | 6.5 parts |
| Sucrose | 30.5 parts |
| Non-fatty acid soap surfactant part | 10.0% |
| Dodecane-1,2-diol acetic acid ether sodium salt | 30.0 parts |
| N-lauroyl-N'-carboxymethyl-N'-hydroxyethyl ethylenediamine sodium salt | 20.0 parts |
| Polyoxyethylene 60 mol hydrogenated oil | 50.0 parts |

-continued

| | |
|---|---|
| The others | (17.0%) |
| PEG-90M | 0.005% |
| Chelator | 0.1% |
| Titanium oxide | 0.2% |
| Sodium hexametaphosphate | 0.2% |
| Ion exchanged water | 16.495% |

Production Method

Production equipment 10 of air bubble-containing framed soap of the present invention is shown in the FIG. 1.

The production equipment 10 is equipped with a melting pot 12, in which the above-described basic formulation components are heated and melted, a pump 14 with which the molten soap is transferred from the melting pot 12, and a cooling container 16 having plural bottomed cylindrical cooling frames. The molten soap that is pumped out from the melting pot 12 with the pump 14 is poured into the cooling frames of the cooling container 16. After cooling and solidification, the bar soap (material bar) is removed from the cooling frame, then cut and shaped.

In the present invention, in order to produce air bubble-containing soap, an air injection pipe 18 is placed inside the melting pot 12. While the bubbling is being carried out, the stirring is performed with a stirring blade 20.

The uniqueness of the present invention is that a means for entraining fine bubbles is provided when the molten soap is pumped into the cooling container 16. In the following tests of the present invention, a pipeline mill was used as the means for entraining fine bubbles.

Figure 2:
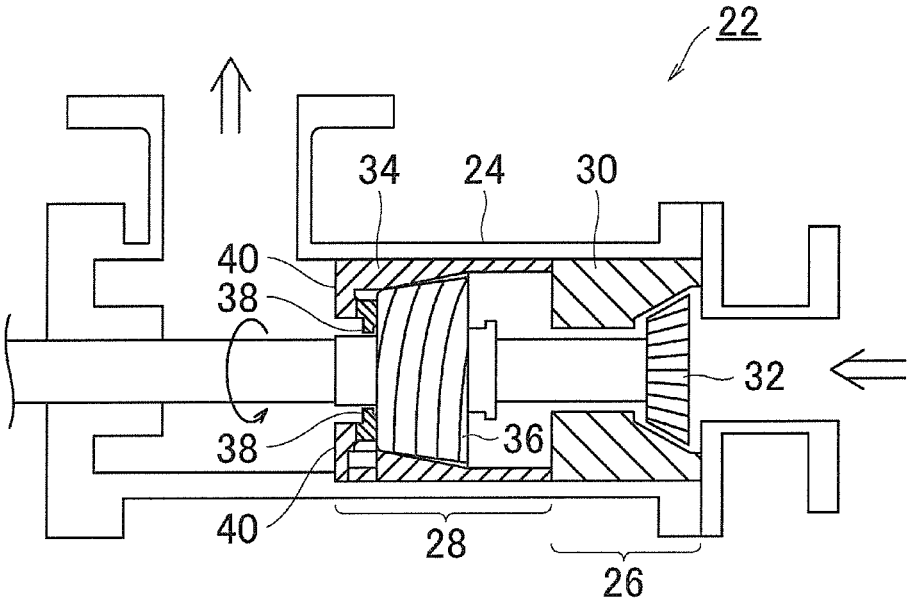
FIG. 2 is an illustration of the main section of a pipeline mill, which is characteristic of the present invention.

In the present embodiment, the pipeline mill is equipped with a cylindrical stator of about the same diameter (100 to 200 mm) as the pipe and a rotor that has a gap of 0.4 mm or less to the stator, rotates around the same axis as the flow channel, and has blades on its outer periphery. That is, the pipeline mill 22 is equipped with a first crushing section 26 and a second crushing section 28, as shown in the cross-sectional drawing in FIG. 2, in an L-shaped cylindrical housing 24 with an opening size of about 100 mm. The first crushing section is equipped with a first mortar-shaped cylindrical stator 30 and a first flat-head conical rotor 32, which is tailored to the mortar shape of the first stator 30, and applies a stirring/shearing force to the molten soap that flows in from the right side in the figure. The second crushing section 28 is similarly equipped with a second mortar-shaped cylindrical stator 34, a second flat-head conical rotor 36, which is tailored to the mortar shape of the second stator 34, and a grinding section 38, which is installed at the top section of the second rotor 36. The gap between the grinding section 38 and the opposing section 40 of the second rotor 36 is adjustable. In addition, concaves and convexes are formed on each of the grinding section 38 and the opposing section 40, the gap between them is adjustable within the range of 0.1 to 5 mm, and the rotor speed is 2000 to 4000 rpm.

In the below-described test examples, the rotor speed was adjusted to 3500 rpm. Unless otherwise specified, the gap between the grinding section and the opposing section of the pipeline mill was adjusted to 0.2 mm.

Figure 3:
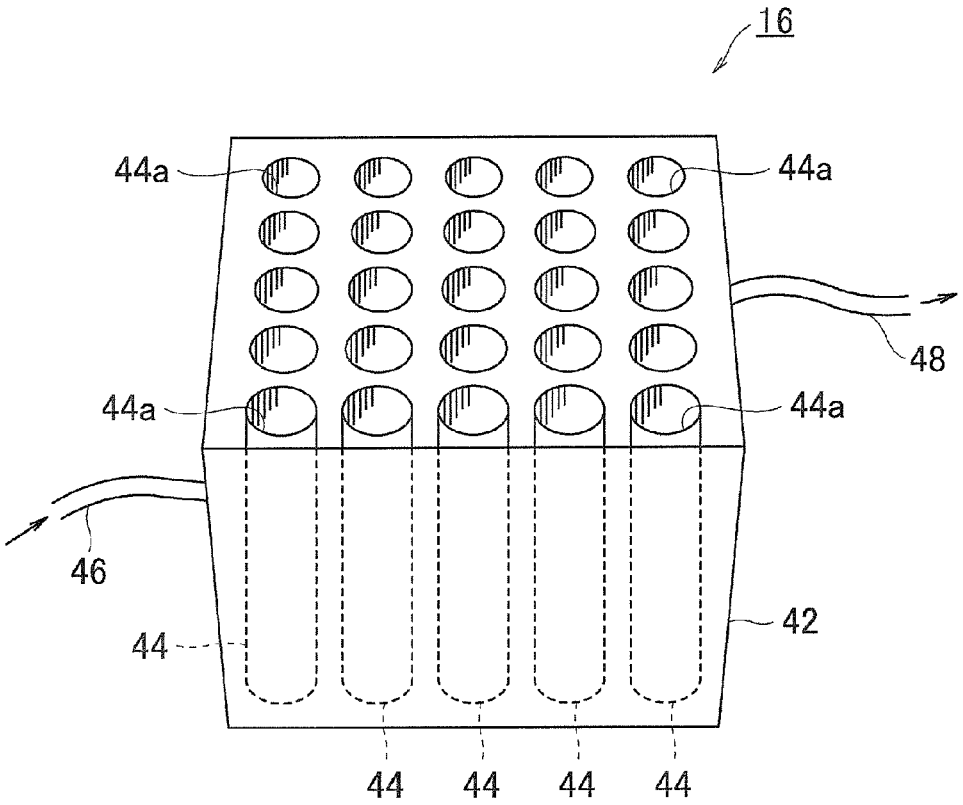
FIG. 3 is an illustration of the common cooling container used in the present invention.

In the present embodiment, as the cooling container 16, 25 cylindrical cooling frames 44 are arranged inside a cubic main body 42 as shown in FIG. 3, and openings 44*a* of the respective cooling frames 44 are formed on the top surface of the main body 42. To the main body 42, cooling water is introduced through a cooling water introduction route 46 and discharged through a discharge route 48.

The cooling frame 44 used in the present test was of a diameter of 50 mm and a length (height) of 1000 mm. The molten soap a t the time of pumping into the cooling frame was 60 to 65° C. unless otherwise specified. Immediately after pumping into the cooling container 16, the cooling was carried out with cooling water at 20° C.

TABLE 1

| | Test Example | | | | |
|---|---|---|---|---|---|
| | 1-1 | 1-2 | 1-3 | 1-4 | 1-5 |
| Apparatus | none | pipeline homomixer (※1) | pipeline mill (0.5 mm) | pipeline mill (0.2 mm) | pipeline mill (0.1 mm) |
| Air bubble diameter of molten soap in the pot (μm) | 40 | 40 | 40 | 40 | 40 |
| Air bubble diameter of discharge molten soap (μm) | 40 | 30 | 30 | 20 | 15 |
| Appearance of material bar | fracture generation | fracture generation | slightly rough | smooth | smooth |
| Air bubble content after solidification (%) | 25 | 25 | 25 | 25 | 25 |
| Specific gravity of top of frame | 0.754 | 0.791 | 0.81 | 0.847 | 0.851 |
| Specific gravity of middle of frame | 0.802 | 0.836 | 0.844 | 0.857 | 0.859 |
| Specific gravity of bottom of frame | 0.995 | 0.96 | 0.894 | 0.868 | 0.863 |

(※1): A stirring blade is contained inside the cylindrical stator.

As is clear from Table 1, the production of the framed soap containing air bubbles has become possible with the use of a pipeline mill. In particular, if the bubble diameter is made to be 30 μm or smaller with the mill, the appearance of the material bar becomes smooth. In addition, the weight distribution (distribution of air bubbles) in the cooling frame becomes extremely good. Thus, the use of a pipeline mill is very preferable to uniformly entrain air bubbles. It is practically unachievable by stirring with only the stirring blade inside the pot or that inside the pipe.

The present inventors have investigated stirring conditions only with the stirring blade The present inventors have investigated stirring conditions only with the stirring blade in the melting pot 12. As shown in Table 2 below, the air bubble diameter of about 40 μm was the limit. When the molten soap of a very large air bubble diameter was poured into the cooling container, cracks and fractures were generated at the removal stage of the material bar.

TABLE 2

| | Test Example | | | |
|---|---|---|---|---|
| | 2-1 | 2-2 | 2-3 | 2-4 |
| Stirring time (minutes) | 0 | 10 | 30 | 80 |
| Air bubble diameter of molten soap in the pot (μm) | 0 | 110 | 85 | 40 |
| Air bubble content in the pot (%) | 0 | 14.2 | 25.5 | 34.3 |
| Apparatus | none | none | none | none |
| Appearance of material bar | — | fracture generation | fracture generation | fracture generation |
| Air bubble content after solidification (%) | 0 | 11.9 | 19 | 25.2 |
| Specific gravity of top of frame | 1.139 | 0.944 | 0.863 | 0.756 |
| Specific gravity of middle of frame | 1.138 | 0.998 | 0.908 | 0.806 |
| Specific gravity of bottom of frame | 1.143 | 1.06 | 0.997 | 0.995 |

As described above, in the production of air bubble-containing soap by the framing method, air bubbles cannot be made to be sufficiently small by the stirring with the stirring blade in the melting pot or that in the pipeline. As a result, defects such as fractures and cracks are generated in the material bar; in addition, the distribution of air bubbles inside the frame becomes non-uniform.

On the other hand, after air bubbles are entrained in the melting pot, framed soap that is uniform and troubleless in the removal of the material bar can be produced by applying a pipeline mill immediately before pumping into the cooling container and allowing the air bubble diameter to be smaller.

Thus, by the adoption of a pipeline mill, a large amount of uniform air bubbles can be entrained in the so-called framed soap.

Subsequently, the present inventors have investigated, for the soap of the basic formulation produced by the system of FIG. 1 in which a pipeline mill was adopted, concerning the air bubble diameter before solidification (air bubble diameter in the melting pot and the air bubble diameter after pipeline milling) and the air bubble diameter of the soap after solidification. Then, each obtained soap was evaluated in the above-described method for the evaluation test.

Here, the bubbling and stirring in the melting pot was carried out for 60 minutes. The results are shown in the Table 3.

TABLE 3

| | | Test Example | | |
|---|---|---|---|---|
| | | 3-1 | 3-2 | 3-3 |
| Before solidification | Air bubble diameter of molten soap in the pot (μm) | 43 | 49 | 60 |
| | Air bubble diameter of discharge molten soap (μm) (after pipeline milling) | 29 | 36 | 25 |
| After solidification | Air bubble diameter of soap (μm) | 34 | 47 | 49 |
| Fracture resistance | | A | A | A |

According to Table 3, it is clear that even when the soap is produced from the molten soap of the same formulation and under the same conditions, the obtained soap has various number average air bubble diameters. However, there were no fractures on the soap having these number average air bubble diameters, and excellent soap could be obtained.

As a result of further investigation by the present inventors, it was clarified that when molten soap with entrained air bubbles, which have been made smaller with a pipeline mill, is cooled in the cylindrical cooling frame, the air bubble diameter becomes about 5 to 25 μm larger, because of soap shrinkage after solidification, than the diameter before the entry into the cylindrical cooling frame.

Thus, it is necessary to obtain the soap of the present invention by adjusting the air bubble diameter to 40 μm or smaller and preferably 36 μm or smaller with a pipeline mill.

In addition, the obtained soap has a number average particle diameter of preferably 65 μm or smaller and especially preferably 50 μm or smaller.

Figure 4:
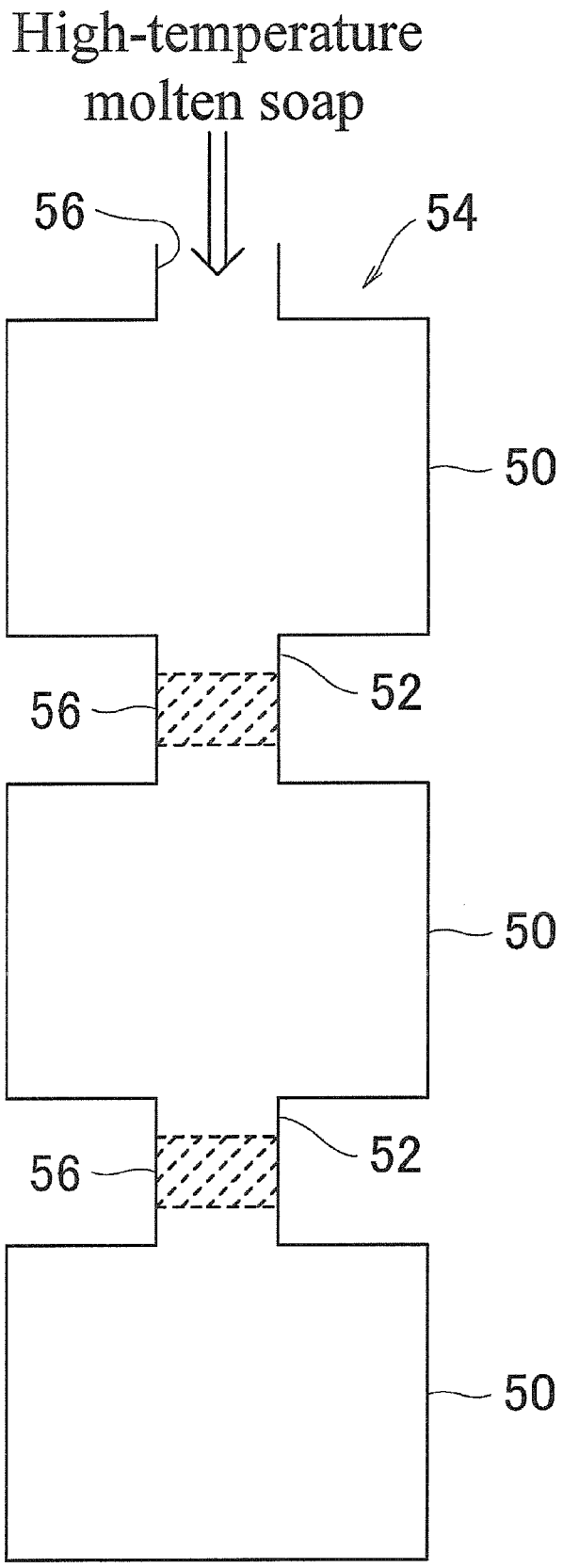
FIG. 4 is another example of the cooling frame (long cylindrical resin container) used in the present invention.

In the present invention, in addition to normal cylindrical cooling frames, a long cylindrical resin container wherein plural individual resin sections are connected through liquid channels can be used as the cooling container. For example, as shown in FIG. 4, a resin container 54 having wide parts 50 and narrow passages 52 can be used. After pumping high-temperature molten soap from the opening on the top, the narrow passage section 52 is joined/sealed (56 in the figure) and individually packaged framed soaps can be prepared.

In addition to the merit that the specific gravity is reduced because of the presence of air bubbles, the framed soap of the present invention can be suitably used, for example, as a small single-use disposal soap that is provided at accommodation facilities. That is, at accommodation facilities, a small single-use disposal soap may be provided to each lodging guest from the standpoint of health. Naturally, when the lodging period is short, the use of soap is very little; however, the usability becomes poor if the soap is too small.

Thus, the usage of soap can be reduced, while the size suitable for use is maintained, by decreasing the soap components with respect to the volume as in the present invention.

When air bubbles are entrained in such a small soap, it is necessary to prevent not only cracks and fractures of a material bar but also fractures of soap itself.

In addition, in the normal soap composition, satisfactory dissolution of cleansing components cannot be expected during use because of a small surface area due to a small size of the soap. Therefore, in such a small soap, it is necessary that the soap is soft and easily soluble during use. Thus, the present inventors also investigated easily soluble soap compositions for a small soap.

At first, the present inventors investigated the fatty acid composition from the standpoint of fracture prevention at the time of removal of a soap material bar. That is, each soap was produced by changing only the composition of the fatty acid soap part in the above-described basic formulation. Then, each obtained soap was evaluated in the above-described methods for the evaluation tests.

The results are shown in the Table 4 and Table 5.

TABLE 4

| | 4-1 | 4-2 | 4-3 | 4-4 | 4-5 |
|---|---|---|---|---|---|
| Lauric acid | 35 | 27 | 30 | 30 | 28 |
| Myristic acid | 65 | 53 | 60 | 60 | 57 |
| Stearic acid | — | 10 | — | 5 | 10 |
| Isostearic acid | — | 10 | 10 | 5 | 5 |
| Counterion | equivalent | equivalent | equivalent | equivalent | equivalent |
| Air bubble content after solidification (%) | 25 | 25 | 25 | 25 | 25 |
| Hardness | 334 | 332 | 305 | 325 | 338 |
| Fracture resistance | B | A | A | A | A |
| Stickiness | A | A | B | A | A |

TABLE 5

| | 5-1 | 5-2 | 5-3 | 5-4 | 5-5 | 5-6 |
|---|---|---|---|---|---|---|
| Lauric acid | 30 | 28 | 25 | 28 | 25 | 22 |
| Myristic acid | 60 | 57 | 55 | 55 | 50 | 46 |
| Stearic acid | 5 | 10 | 15 | 5 | 10 | 15 |
| Isostearic acid | 5 | 5 | 5 | 3 | 3 | 3 |
| Counterion | equivalent | equivalent | equivalent | equivalent | equivalent | equivalent |
| Viscosity increase during reaction | A | A | C | A | A | C |
| Air bubble content after solidification (%) | 25 | 25 | 25 | 25 | 25 | 25 |
| Hardness | 325 | 338 | 335 | 450 | 440 | 532 |
| Fracture resistance | A | A | A | A | A | A |
| Stickiness | A | A | A | A | A | A |

As is clear from Table 4 and Table 5, the fracture resistance of the material bar is improved by blending isostearic acid; however, stickiness tends to be generated. On the other hand, the stickiness suppression effect is displayed by additionally blending stearic acid; however, if an excess amount is blended, thickening takes place during reaction.

As a result of further detailed investigation, it was clarified that by blending 2 to 8 mass % of isostearic acid and 4 to 14 mass % of stearic acid in the fatty acid composition, the fracture resistance could be improved while the stickiness is suppressed.

In addition, the present inventors have carried out the investigation, by assuming the use for a small soap, of the saccharide/moisturizing agent part to improve the during-use solubility. That is, each soap was produced by changing only the composition of the saccharide/moisturizing agent part in the above-described basic formulation. Then, each obtained soap was evaluated in the above-described methods for the evaluation test. The results are shown in the Table 6.

TABLE 6

| | 6-1 | 6-2 | 6-3 | 6-4 | 6-5 |
|---|---|---|---|---|---|
| 1,3-butylene glycol | 15 | 15 | 15 | 15 | 15 |
| POE (7 mol) glyceryl | 10 | 10 | 10 | 10 | 10 |
| Glycerin | 31 | 25 | 25 | 19 | 25 |
| Sucrose | 37 | 32 | 32 | 37 | 32 |
| Sorbitol | 7 | 6 | 6 | 7 | 6 |
| PEG1500 | — | — | 12 | — | 12 |
| PEG4000 | — | 12 | — | 12 | — |
| PEG-90M | — | — | — | — | 0.005%/all quantity of the composition |
| Hardness | 450 | 560 | 530 | 592 | 350 |
| Solubility by rubbing | 69 | 70 | 76 | 70 | 78 |
| Stickiness | B | A | A | B | A |
| Appearance | A | C | A | C | A |

From Table 6, it is seen to be preferable to use PEG1500 in order to improve the usability of a small soap by increasing the solubility by rubbing and improving the formativeness. As a result of further detained investigation, it was clarified that the blending quantity was 5 to 20 mass % in the saccharide/moisturizing agent part.

In addition, by blending 0.005 mass % of PEG-90M in the composition, the hardness was reduced, but the brittleness was improved.

Next, the present inventors have carried out the investigation of the production condition of the soap. That is, each soap of the above-described basic formulation of the present invention was produced, and the freezing point was measured. The relationship between the temperature and the viscosity of the soap was measured using B. F. viscometer (manufactured by BROOKFIELD ENGINEERING). The result is shown in the FIG. 5.

Figure 5:
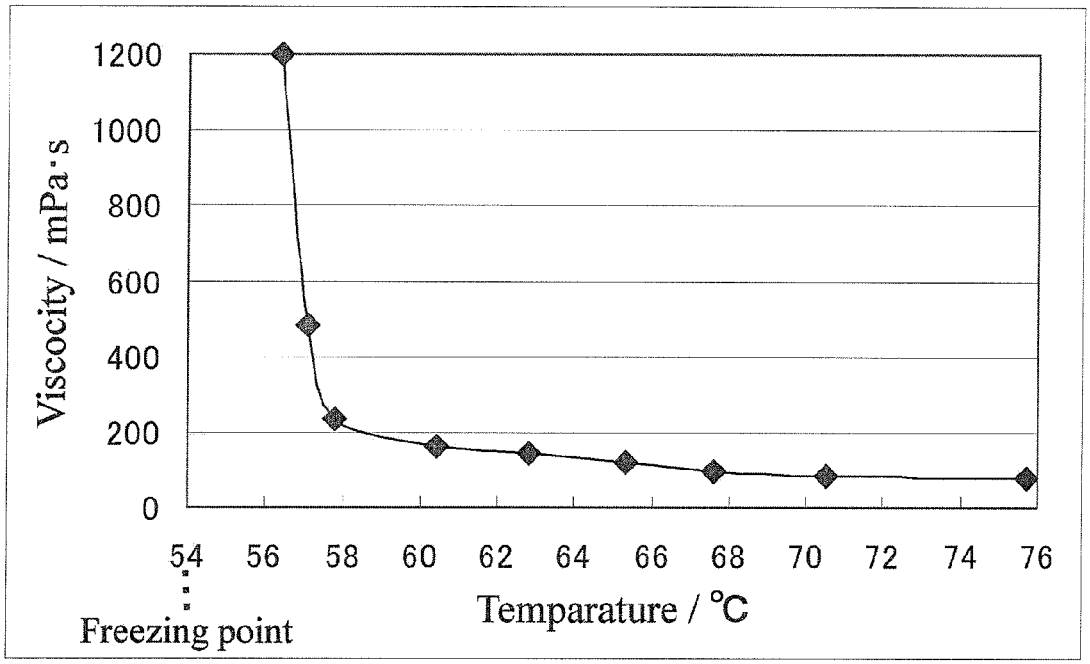
FIG. 5 shows a relationship between the temperature and the viscosity of the framed soap of the present invention.

According to FIG. 5, if the temperature is increased higher than the freezing point (54° C.), the viscosity drops quickly. If the temperature exceeds about 60° C., the viscosity becomes approximately constant.

If the viscosity is high, the coalescence of air bubbles and the separation can be suppressed; however, the efficiency of pumping is lowered. If the temperature is high, the viscosity is low and the efficiency of pumping is increased. However, the cooling takes time, and the coalescence of air bubbles and the separation may take place during cooling.

Thus, it is preferable to produce the soap of the present invention by adjusting the molten soap to 60 to 65° C. when the soap is pumped into the cooling frame.

DESCRIPTION OF THE NUMERALS

10: A production equipment of framed soap
12: A melting pot
14: A pump
16: A cooling container
18: An air injection pipe
20: A stirring blade
22: A pipeline mill
24: A L-shaped cylindrical housing
26: A first crushing section
28: A second crushing section
30: A first mortar-shaped cylindrical stator
32: A first flat-head conical rotor
34: A second mortar-shaped cylindrical stator
36: A second flat-head conical rotor
38: A grinding section
40: An opposing section
42: A cubic main body
44: A cylindrical cooling frame
**44*a***: An opening
46: A cooling water introduction route
48: A discharge route
50: A wide part
52: A narrow passage
54: A resin container
56: A joined/sealed part

What is claimed is:

1. A framed soap which is produced by cooling and solidifying in a cylindrical cooling frame and then cutting and shaping, the framed soap uniformly entraining 10 volume % or higher air bubbles having a number average particle diameter of 65 μm or smaller, wherein a fatty acid soap part is 20 to 40 mass % of the framed soap, and isostearic acid is 2 to 8 mass % and stearic acid is 4 to 14 mass % in the fatty acid soap part; and a saccharide/moisturizing agent part is 30 to 50 mass % of the framed soap.

2. The framed soap according to claim 1, wherein polyethylene glycol 1500 is 5 to 20 mass % in the saccharide/moisturizing agent part.

3. The framed soap according to claim 1, wherein the cylindrical cooling frame is a long cylindrical resin container wherein plural resin individual sections are connected through liquid channels.

4. The framed soap according to claim 1, wherein the framed soap is a small soap of 50 g or less.

5. A production method of a framed soap, comprising:

cooling and solidifying a molten soap in a cylindrical cooling frame and then cutting and shaping, wherein when the molten soap having entrained air bubbles is pumped into the cylindrical cooling frame, the method further comprising breaking down and homogenizing the air bubbles by a mill arranged in the vicinity of a pumping pipe spout and pumping the molten soap into the cooling frame; and the framed soap uniformly entrains 10 volume % or higher air bubbles having a number average particle diameter of 65 μm or smaller;

a fatty acid soap part is 20 to 40 mass % of the framed soap, and isostearic acid is 2 to 8 mass % and stearic acid is 4 to 14 mass % in the fatty acid soap part; and a saccharide/moisturizing agent part is 30 to 50 mass % of the framed soap.

6. The production method according to claim 5, wherein the mill is equipped with a cylindrical stator of about the same diameter as the pipe and a rotor that has a gap of 0.4 mm or less to the stator, rotates around the same axis as the flow channel, and has blades on its outer periphery.

7. The production method according to claim 6, wherein the diameter of the cylindrical stator is 100 to 200 mm and the rotor speed is 2000 to 4000 rpm.

8. The production method according to claim 5, wherein the molten soap is 60 to 65° C. when the soap is pumped into the cooling frame.

9. The framed soap according to claim 2, wherein the cylindrical cooling frame is a long cylindrical resin container wherein plural resin individual sections are connected through liquid channels.

10. The framed soap according to claim 2, wherein the framed soap is a small soap of 50 g or less.

11. The framed soap according to claim 3, wherein the framed soap is a small soap of 50 g or less.

12. The production method according to claim 4, wherein the molten soap is 60 to 65° C. when the soap is pumped into the cooling frame.

13. A production method of the framed soap of claim 1, comprising:

when a high-temperature molten soap having entrained air bubbles is pumped into a cylindrical cooling frame, breaking down and homogenizing the air bubbles by a mill arranged in the vicinity of a pumping pipe spout and pumping the molten soap into the cooling frame.

14. The production method according to claim 13, wherein the mill is equipped with a cylindrical stator of about the same diameter as the pipe and a rotor that has a gap of 0.4 mm or less to the stator, rotates around the same axis as the flow channel, and has blades on its outer periphery.

15. The production method according to claim 14, wherein the diameter of the cylindrical stator is 100 to 200 mm and the rotor speed is 2000 to 4000 rpm.

* * * * *